US007962333B2

(12) United States Patent
Jabri et al.

(10) Patent No.: US 7,962,333 B2
(45) Date of Patent: Jun. 14, 2011

(54) METHOD FOR HIGH QUALITY AUDIO TRANSCODING

(75) Inventors: Marwan A. Jabri, Tiburon, CA (US); Jianwei Wang, Larkspur, CA (US); Nicola Chong-White, Chatswood (AU); Michael Ibrahim, Ryde (AU)

(73) Assignee: Onmobile Global Limited, Bangalore (IN)

( * ) Notice: Subject to any disclaimer, the term of this patent is extended or adjusted under 35 U.S.C. 154(b) by 895 days.

(21) Appl. No.: 11/890,283

(22) Filed: Aug. 2, 2007

(65) Prior Publication Data

US 2008/0195384 A1 Aug. 14, 2008

Related U.S. Application Data

(63) Continuation of application No. 10/754,468, filed on Jan. 9, 2004, now Pat. No. 7,263,481.

(60) Provisional application No. 60/439,420, filed on Jan. 9, 2003.

(51) Int. Cl.
*G10L 19/12* (2006.01)

(52) U.S. Cl. ..... 704/221; 704/220; 704/219; 704/223; 704/200.1; 375/240; 370/466

(58) Field of Classification Search ..... 704/219, 704/221, 220, 223, 200.1, 500–504, 222; 375/240; 370/466
See application file for complete search history.

(56) References Cited

U.S. PATENT DOCUMENTS 5,491,771 A 2/1996 Gupta et al.
5,495,555 A 2/1996 Swaminathan
5,704,001 A * 12/1997 Gardner ..... 704/219
5,751,903 A * 5/1998 Swaminathan et al. ..... 704/230
5,845,244 A 12/1998 Proust
6,012,024 A * 1/2000 Hofmann ..... 704/219
6,026,356 A * 2/2000 Yue et al. ..... 704/201
6,104,992 A * 8/2000 Gao et al. ..... 704/220
6,188,980 B1 2/2001 Thyssen
6,249,758 B1 6/2001 Mermelstein (Continued)

FOREIGN PATENT DOCUMENTS

WO WO 00/48170 8/2000

(Continued)

OTHER PUBLICATIONS

Chen et al., "Improving the Performance of the 16kb/s LD-CELP Speech Coder," IEEE, Mar. 23, 1992, pp. 69-72.

(Continued)

*Primary Examiner* — Vijay B Chawan
(74) *Attorney, Agent, or Firm* — Hoffmann & Baron, LLP

(57) ABSTRACT

A method and apparatus for a voice transcoder that converts a bitstream representing frames of data encoded according to a first voice compression standard to a bitstream representing frames of data according to a second voice compression standard using perceptual weighting that uses tuned weighting factors, such that the bitstream of a second voice compression standard to produce a higher quality decoded voice signal than a comparable tandem transcoding solution. The method includes pre-computing weighting factors for a perceptual weighting filter optimized to a specific source and destination codec pair, pre-configuring the transcoding strategies, mapping CELP parameters in the CELP parameter space according to the selected coding strategy, performing Linear Prediction analysis if specified by the transcoding strategy, perceptually weighting the speech using with tuned weighting factors, and searching for adaptive codebook and fixed-codebook parameters to obtain a quantized set of destination codec parameters.

12 Claims, 13 Drawing Sheets

U.S. PATENT DOCUMENTS

| | | | | |
|---|---|---|---|---|
| 6,345,255 | B1 * | 2/2002 | Mermelstein | 704/500 |
| 6,604,070 | B1 * | 8/2003 | Gao et al. | 704/222 |
| 6,691,085 | B1 * | 2/2004 | Rotola-Pukkila et al. | 704/228 |
| 6,757,649 | B1 | 6/2004 | Gao et al. | |
| 6,829,579 | B2 | 12/2004 | Jabri et al. | |
| 6,961,698 | B1 * | 11/2005 | Gao et al. | 704/229 |
| 7,184,953 | B2 * | 2/2007 | Jabri et al. | 704/221 |
| 2002/0016161 | A1 * | 2/2002 | Dellien et al. | 455/403 |
| 2002/0077812 | A1 | 6/2002 | Masano et al. | |
| 2003/0028386 | A1 * | 2/2003 | Zinser et al. | 704/500 |
| 2004/0002856 | A1 * | 1/2004 | Bhaskar et al. | 704/219 |
| 2004/0158647 | A1 | 8/2004 | Omura | |

FOREIGN PATENT DOCUMENTS

| | | | |
|---|---|---|---|
| WO | WO 01/69936 | A2 | 9/2001 |
| WO | WO 02/080147 | A | 10/2002 |
| WO | WO 02/080417 | | 10/2002 |
| WO | WO 03/058407 | A2 | 7/2003 |

OTHER PUBLICATIONS

Kim et al., "An Efficient Transcoding Algorithm for G.723.1 and EVRC Speech Coders". Vehicular Technology Conference, 2001. VTC 2001 Fall. IEEE, VTS 54th, vol. 3, Oct. 7, 2001, pp. 1561-1564.

* cited by examiner

METHOD FOR HIGH QUALITY AUDIO TRANSCODING

CROSS-REFERENCES TO RELATED APPLICATIONS

This application is a continuation of U.S. patent application Ser. No. 10/754,468, filed on Jan. 9, 2004, which claims priority to U.S. Provisional Patent Application No. 60/439,420, filed on Jan. 9, 2003, the disclosures of which are incorporated by reference herein for all purposes.

BACKGROUND OF THE INVENTION

The present invention relates generally to processing telecommunication signals. More particularly, the invention relates to a method and apparatus for improving the output signal quality of a transcoder that translates digital packets from one compression format to another compression format. Merely by way of example, the invention has been applied to voice transcoding between Code-Excited Linear Prediction (CELP) codecs, but it would be recognized that the invention has a much broader range of applicability. To this end, the class of applicable codecs is designated as being "common" codecs.

The process of converting from one voice compression format to another voice compression format can be performed using various techniques. The tandem coding approach is to fully decode the compressed signal back to a Pulse-Code Modulation (PCM) representation and then re-encode the signal. This requires a large amount of processing and incurs increased delays. More efficient approaches include transcoding methods where the compressed parameters are converted from one compression format to the other while remaining in the parameter space.

Many of the current standardized low bit rate speech coders are based on the Code-Excited Linear Prediction (CELP) model. Common parameters of a CELP coder are the linear prediction parameters, adaptive codebook lag and gain parameters, and fixed codebook index and gain parameters.

The similarities between CELP-based codecs allow one to take advantage of the processing redundancies inherent in them. FIG. 1 shows a block diagram for a typical prior art CELP decoder. The decoder receives as input a bitstream consisting of several parameters, commonly representing the fixed codebook index, fixed codebook gain, adaptive codebook gain, adaptive codebook (pitch) lag and the linear prediction (LP) parameters. The decoder constructs the fixed codeword, which is then scaled by the codebook gain. The adaptive codeword, which is a previous excitation segment that has been delayed by the pitch lag and scaled by the adaptive gain, is added to the fixed codebook contribution. The resulting excitation signal is then filtered by a short term predictor producing synthesized speech. This speech is then post-filtered in order to reduce the perceptual significance of any synthesis artifacts and improve speech quality.

FIG. 2 shows a block diagram for a typical prior art CELP encoder. The incoming speech signal is first pre-processed, for example, high-pass filtered to get rid of any superfluous information such as very low frequency information. Next, the spectral shape information is extracted by linear prediction (LP) analysis. The LP parameters are often represented as Line Spectral Pairs (LSPs) and quantized. The speech signal is then filtered using the inverse LP synthesis filter to remove the spectral envelope contribution and produce the excitation signal. Both the pre-processed speech and excitation are filtered with a perceptual weighting filter. The perceptually weighted speech is analyzed for periodicity, often using both a open loop pitch lag search and a closed loop (analysis-by-synthesis) pitch lag and pitch gain search. The pitch contribution is subtracted from the perceptually weighted speech to create a target signal for the fixed codebook search. The fixed codebook search consists of an analysis-by-synthesis algorithm, in which various code words are evaluated to minimize the error between the synthesized codeword and target signal.

Transcoding addresses the problem that occurs when two incompatible standard coders need to interoperate. The conventional prior art tandem coding solution, illustrated in FIG. 3, is to fully decode the signal from one compression format to PCM, and then to re-encode the PCM signal using the other compression format. This solution has the disadvantages of being computationally complex, it and introduces quality degradations due to the full decode and full encode. Alternatively a prior art transcoder, as shown in FIG. 4, may be used which converts the bitstream from one compression format to a different compression format without fully decoding to PCM and then re-encoding the signal.

Some transcoding approaches involve converting parameters solely in the CELP domain. These methods have the advantage of reducing computational complexity. FIG. 5 shows an example of one prior art transcoding approach in which the source codec LSPs are directly translated and quantized to the destination codec format. The speech is then synthesized using the destination codec LSPs and the remaining CELP parameters are found using a searching algorithm. This technique does not improve the quality of the transcoded signal to the fullest extent and is not necessarily the best solution in some situations.

While smart transcoding techniques that map parameters from one CELP format to another in a fast manner have been developed, a transcoding solution that provides transcoded speech of a higher quality than the conventional tandem coding solution and that may be configured and tuned for specific source and destination codec pairs is highly desirable.

SUMMARY OF THE INVENTION

According to the invention, a method and apparatus are provided for improving the output signal quality of a transcoder that translates digital packets from one compression format to another compression format by including perceptually weighting of the speech using a weighting filter with tuned weighting factors. Merely by way of example, the invention has been applied to voice transcoding between Code-Excited Linear Prediction (CELP) codecs, but it would be recognized that the invention has a much broader range of applicability, as explained herein and hereinafter referred to as common codecs.

In a specific embodiment, the present invention provides a method and apparatus for high quality voice transcoding between CELP-based voice codecs. The apparatus includes an input CELP parameters unpacking module that converts input bitstream packets to an input set of CELP parameters; a linear prediction parameters generation module for determining the destination codec Linear Prediction (LP) parameters, a perceptual weighting filter module that uses tuned weighting factors, an excitation parameter generation module for determining the excitation parameters for the destination codec, a packing module to pack the destination codec bitstream, and a control module that configures the transcoding strategies and controls the transcoding process. The linear prediction parameters generation module includes an LP analysis module and an LP parameter interpolation and mapping module. The excitation parameter generation module includes adaptive and fixed codebook parameter searching modules and adaptive and fixed codebook parameter interpolation and mapping modules.

The method includes pre-computing weighting factors for a perceptual weighting filter that are optimized to a specific source and destination codec pair and storing them to the systems, pre-configuring the transcoding strategies, unpacking the source codec bitstream, reconstructing speech, mapping at least one but typically more than one CELP parameter in the CELP parameter space according to the selected coding strategy, performing LP analysis if specified by the transcoding strategy, perceptually weighting the speech using a weighting filter with tuned weighting factors, and searching for one or more of the adaptive codebook and fixed-codebook parameters to obtain the quantized set of destination codec parameters. Reconstructing speech does not involve any post-filtering processing. In addition, the reconstructed speech passed as input to the LP analysis and speech perceptual weighting does not undergo any pre-processing filtering or noise suppression. Mapping one or more CELP parameters includes interpolating parameters if there is a difference in frame size or subframe size between the source and destination codecs. The CELP parameters may include LP coefficients, adaptive codebook pitch lag, adaptive codebook gain, fixed codebook index, fixed codebook gain, excitation signals, and other parameters related to the source and destination codecs. Searching for adaptive codebook and fixed codebook parameters may be combined with mapping and conversion of CELP parameters to achieve high voice quality. This is controlled by the transcoding strategy. The algorithms within the searching module can be different to the algorithms used in the standard destination codec itself.

An advantage of the present invention is that it provides a transcoded voice signal with higher voice quality and lower complexity than that provided by a tandem coding solution. The processing strategy that combines both mapping and searching processes for determining parameter values can be adapted to suit different source and destination codec pairs.

The objects, features, and advantages of the present invention, which to the best of our knowledge are novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE INVENTION

In a specific embodiment of the invention, a Code-Excited Linear Prediction (CELP) based compression scheme is employed. Audio compression using a CELP-based compression scheme is a common technique used to reduce data bandwidth for audio transmission and storage. Hence, any common codec for which a common codec parameter space is defined may be used. In many situations, the ability to communicate across different networks is desirable, for example from an Internet Protocol (IP) network to a cellular mobile network. These networks use different CELP compression schemes in order to communicate audio, and in particular voice. Different CELP coding standards, although incompatible with each other, generally utilize similar analysis and compression techniques.

Figure 1:
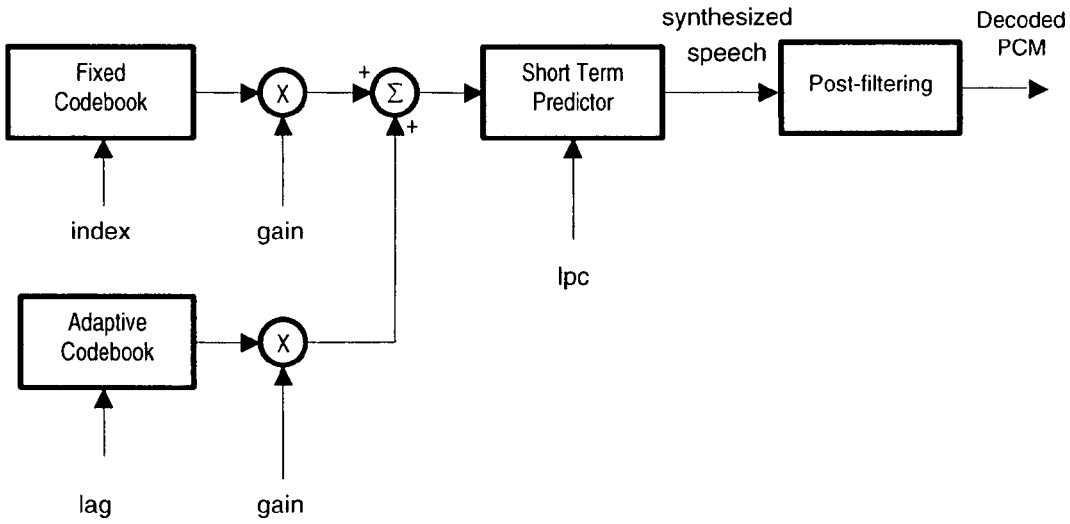
Figure 1 Prior Art
FIG. 1 is a simplified block diagram illustrating an example of a prior art CELP decoder.
Figure 2:
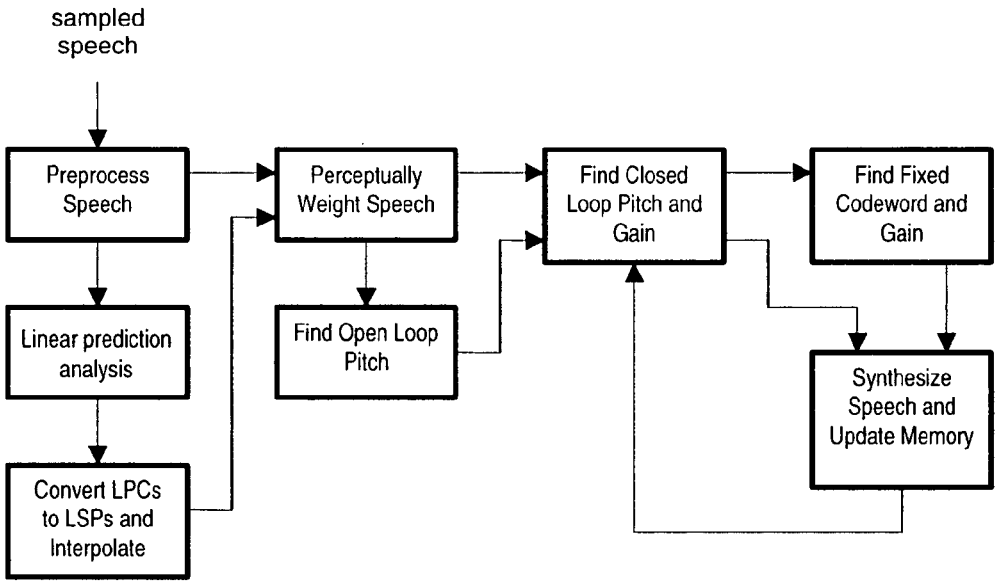
Figure 2 Prior Art
FIG. 2 is a simplified block diagram illustrating an example of a prior art CELP encoder.
Figure 3:
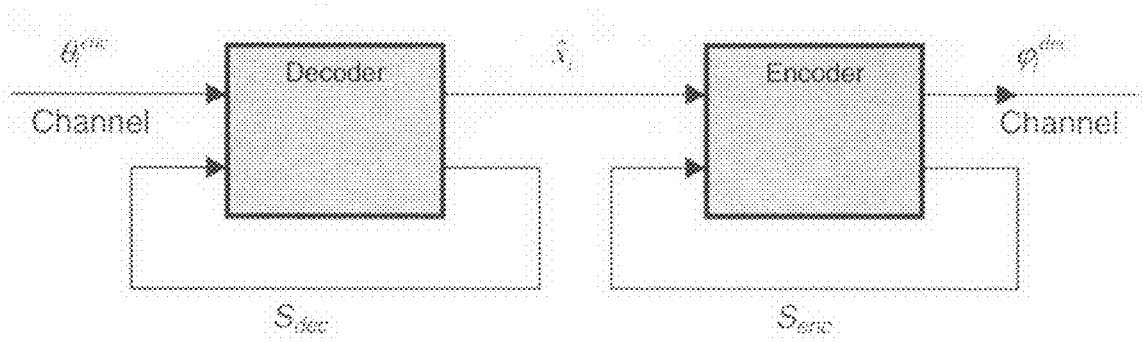
Figure 3 Prior Art
FIG. 3 is a simplified block diagram illustrating a prior art tandem coding procedure.
Figure 4:
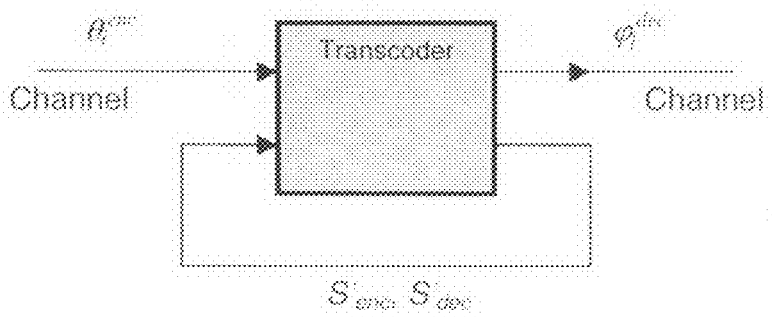
Figure 4 Prior Art
FIG. 4 is a simplified block diagram illustrating a transcoding procedure of the prior art which does not fully decode and re-encode the signal.
Figure 5:
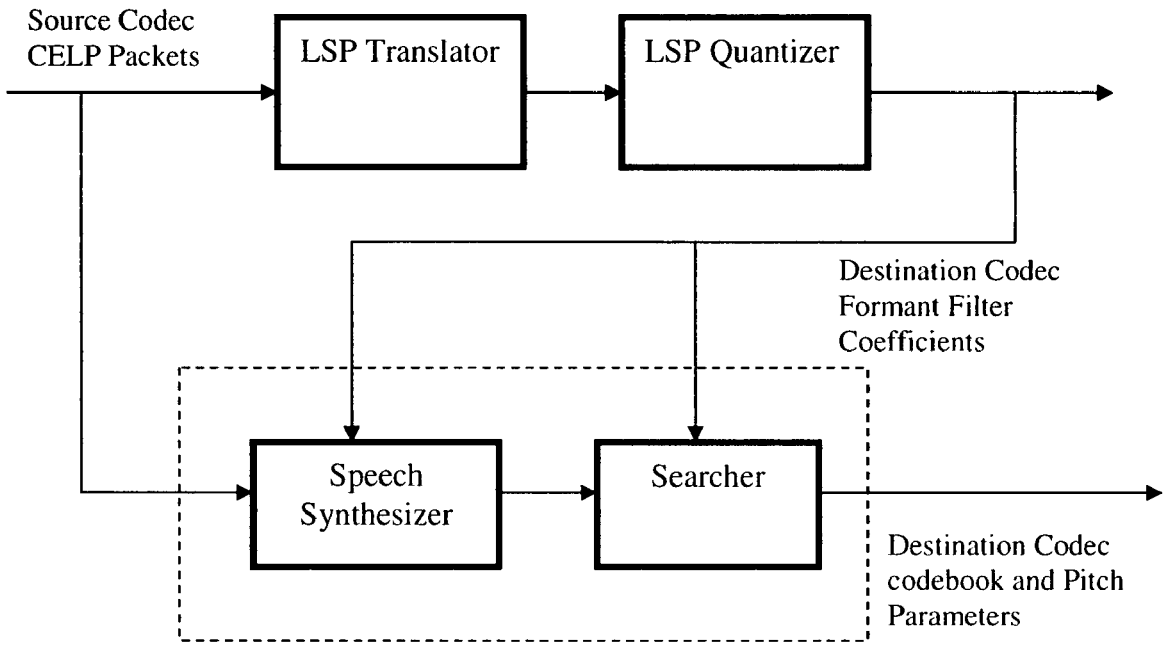
Figure 5 Prior Art
FIG. 5 is a simplified block diagram of a prior-art transcoding approach.
Figure 6:
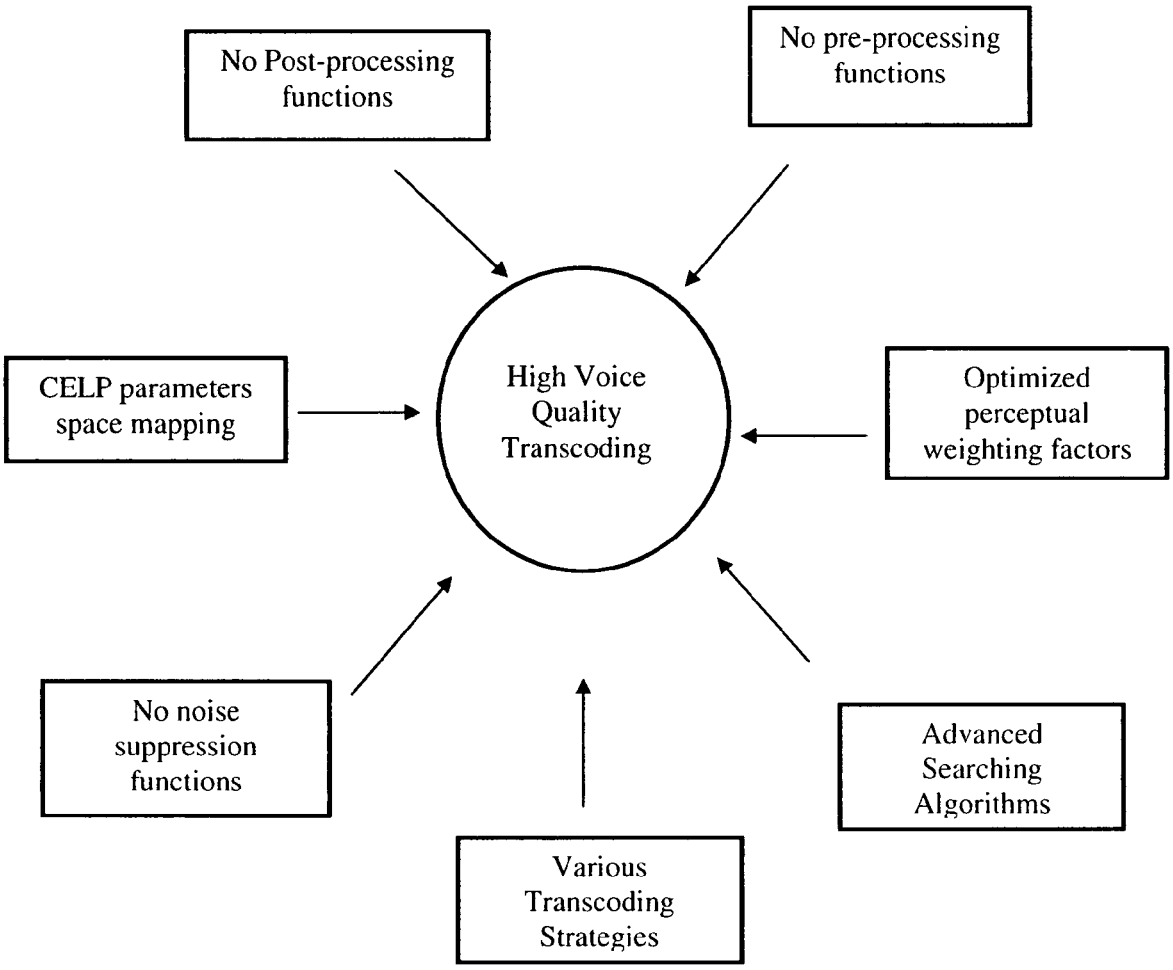
FIG. 6 is a diagram representation of high voice quality transcoder methods.

FIG. 6 shows a diagram illustrating several factors that contribute to a target or high voice quality resulting from transcoding according to the present invention. In addition to the removal of post-processing and pre-processing functions, the use of optimized perceptual weighting factors, configured transcoding strategies, mapping of parameters in the CELP domain and advanced searching functions contribute to higher quality transcoded signals.

Figure 7:
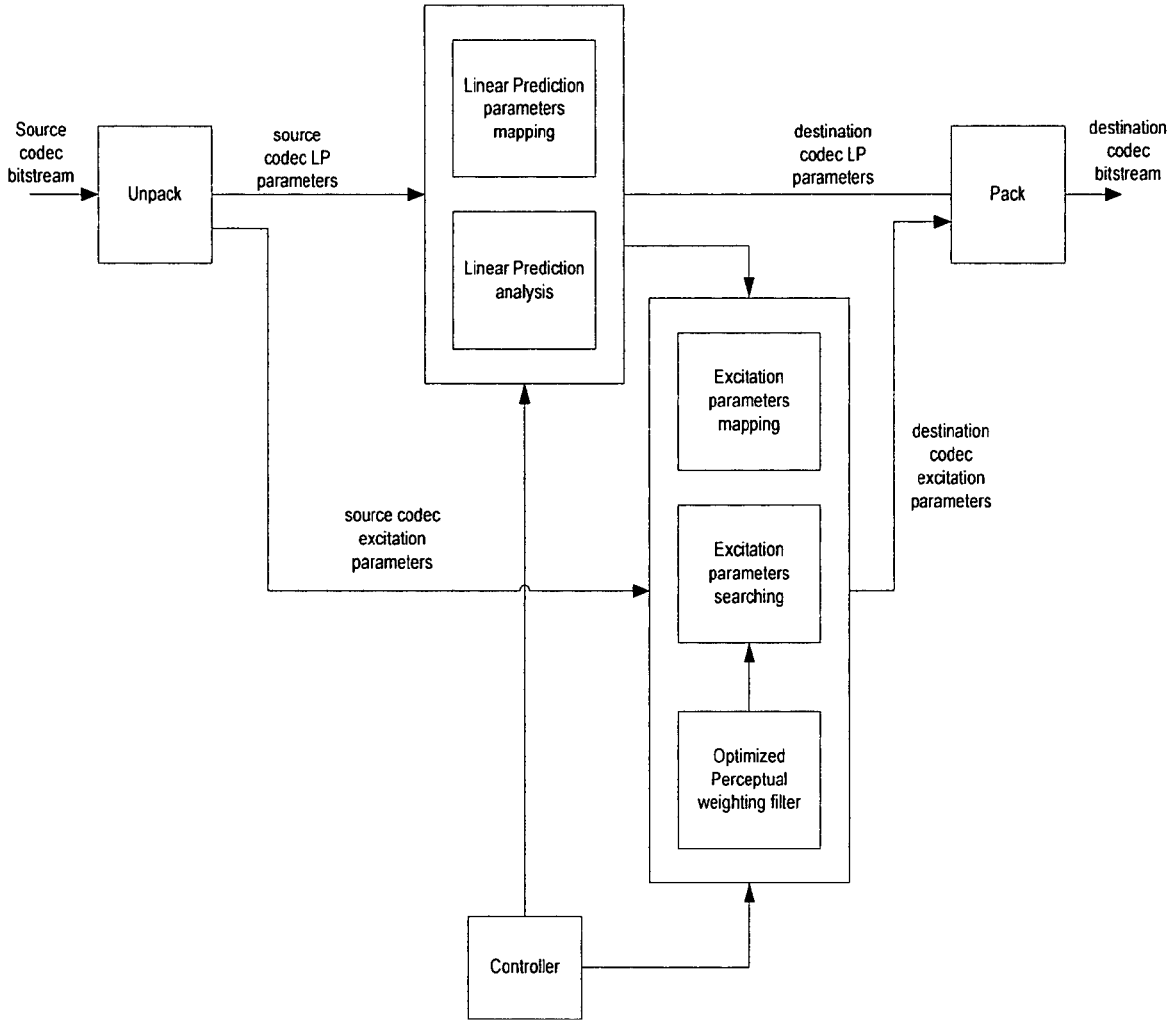
FIG. 7 is a block diagram illustrating a high voice quality transcoder from one CELP-based codec to another CELP-based codec according to an embodiment of the present invention.

FIG. 7 shows a block diagram of a high quality transcoder according to the invention. The apparatus includes a unpacking module that converts input source codec bitstream packets to a set of common codec parameters, such as CELP parameters; a linear prediction parameters generation module for determining the destination codec parameters, such as linear prediction (LP) parameters, a perceptual weighting filter module that uses tuned or customized weighting factors, an excitation parameter generation module for determining the excitation parameters for the destination codec, a packing module to pack the destination codec bitstream, and a control module that configures the transcoding strategies and controls the transcoding process. The linear prediction parameters generation module includes a linear prediction (LP)

analysis module, and an LP parameter interpolation and mapping module. The excitation parameter generation module includes adaptive and fixed codebook parameter searching modules and adaptive and fixed codebook parameter interpolation and mapping modules. The control module controls whether parameter mapping or searching is performed, according to the transcoding strategy.

Figure 8:
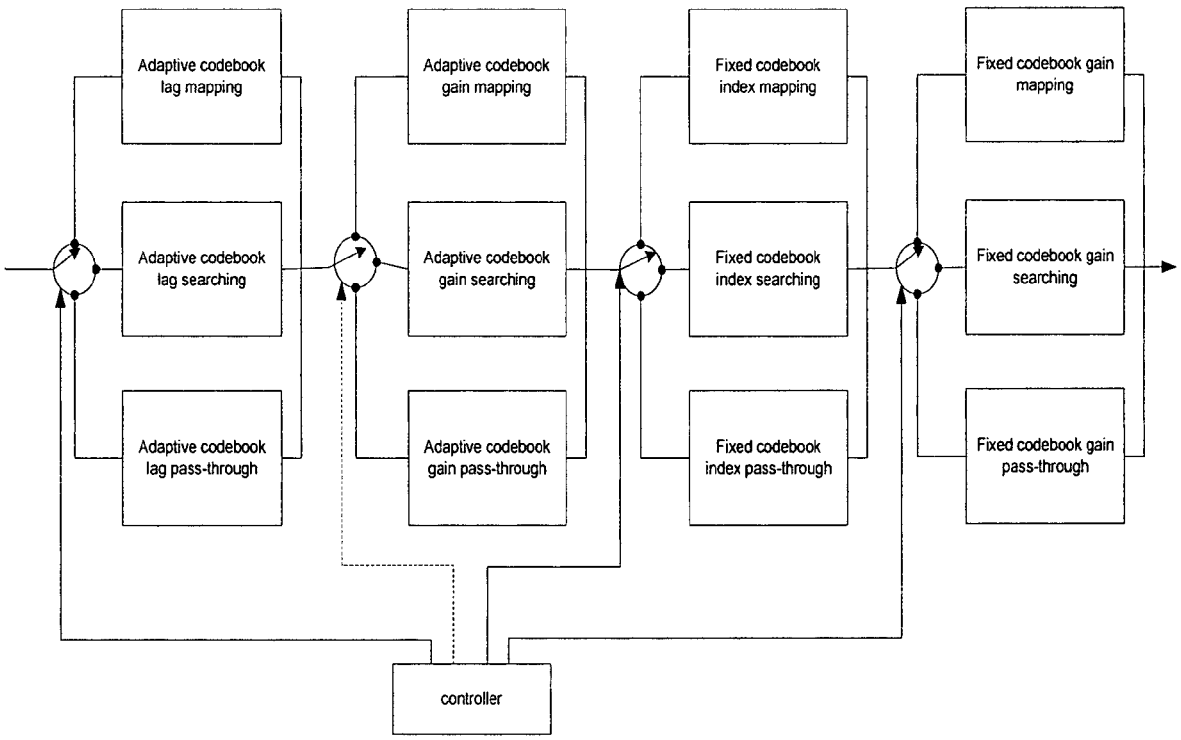
FIG. 8 is a block diagram illustrating the processing options, controlled by the transcoding strategy, in the excitation parameter generation module of a high voice quality transcoder according to an embodiment of the present invention.
Figure 9:
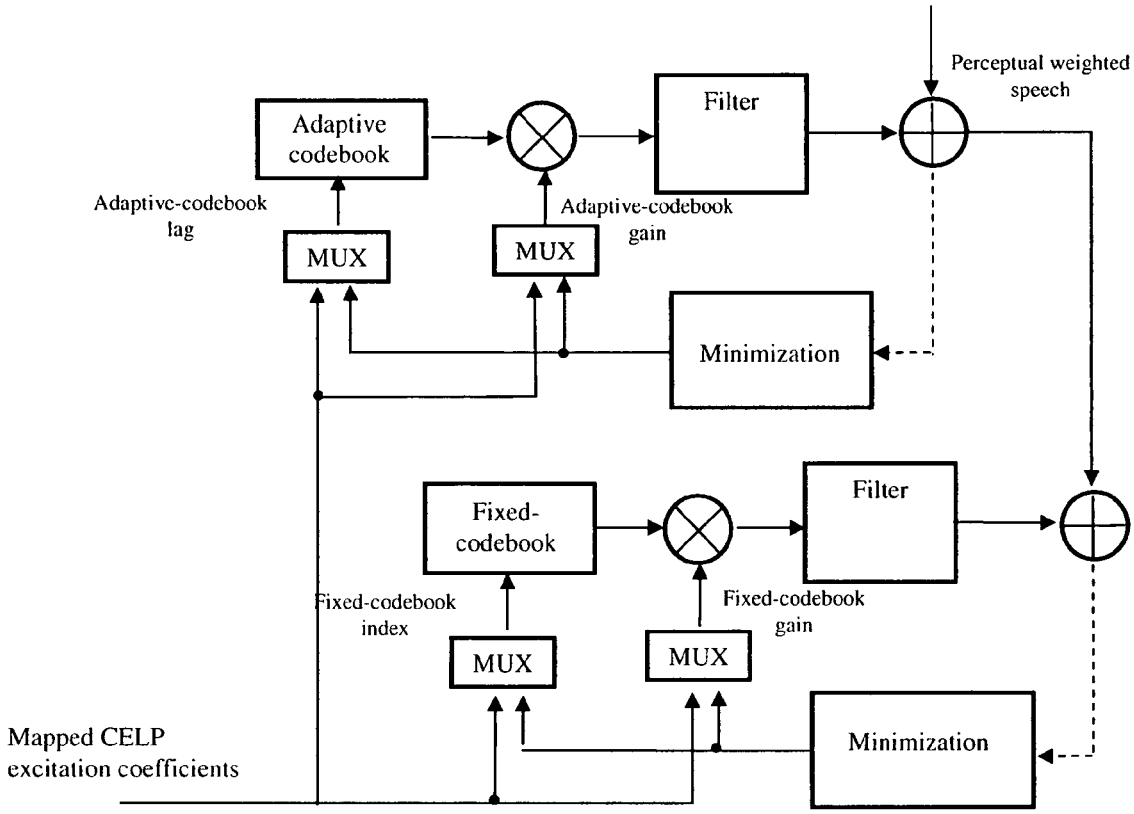
FIG. 9 is an alternative representation of an excitation parameter searching module in a high voice quality transcoder according to an embodiment of the present invention.

The transcoding strategy is configured depending on the similarities of the source and destination codecs, in order to optimize mapping from source encoded CELP parameters into destination encoded CELP parameters. FIGS. 8 and 9 illustrate the excitation parameter generation modules in which one of several searching procedures, such as direct mapping, searching, or (in the case of identical source and destination codecs) pass-through, may be chosen to determine each of the excitation parameters, depending on the transcoding strategy. The algorithms for adaptive codebook searching and fixed codebook searching in the transcoder may differ from those of the conventional or standard destination CELP codec. During searching, perceptual weighting filters are used to shape the quantization noise. The perceptual weighting factors are not necessarily the same as those defined in the destination standard. They can be further fine tuned or customized, for example, by empirical methods, taking into account the source codec characteristics. This operation can further improve audio quality.

The transcoding algorithm of the present invention can be made considerably more efficient than a conventional tandem solution by not using unneeded computationally intensive steps of source codec post-filtering, destination codec pre-filtering, destination codec LP analysis, or destination codec open loop pitch search. Further savings may be realized by directly mapping one or more excitation parameters rather than performing complex searches.

Figure 10:
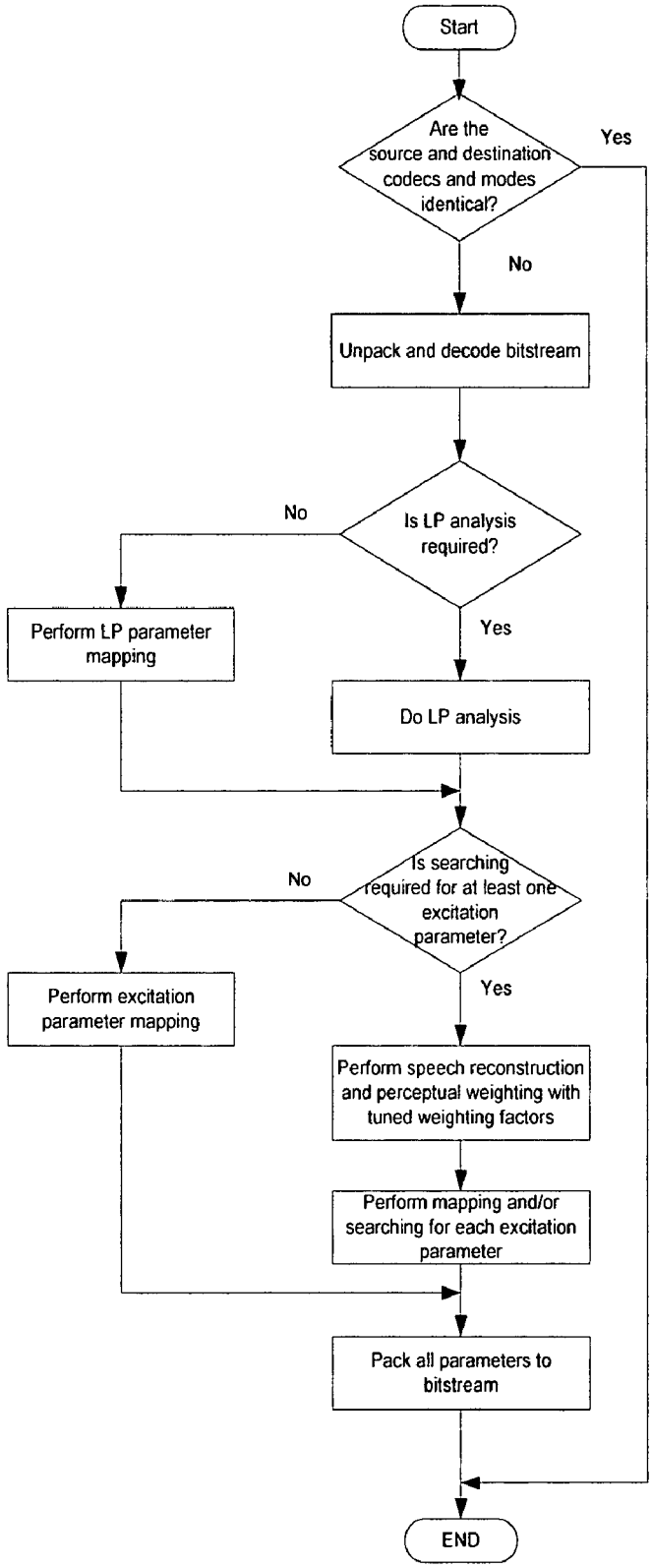
FIG. 10 is a flowchart of a high quality voice transcoding method according to an embodiment of the present invention.

A flowchart of an embodiment of the inventive voice transcoding process is illustrated in FIG. 10. If the source and destination codec type and bit-rate are the same, no (CELP) parameter searching is required, and the output bitstream is set to the input bitstream. Otherwise, the bitstream is unpacked. The excitation signal is reconstructed and the speech is synthesized. A choice is made between performing LP analysis on the synthesized speech or mapping the LP parameters from the source codec. The target and impulse response signals to determine the excitation parameters are generated using a perceptual weighting synthesis filter with weighting factors that are optimized to the specific source codec and destination codec pair. The remaining common codec (CELP) parameters are determined by searching, and then they are packed to the output bitstream.

Figure 11:
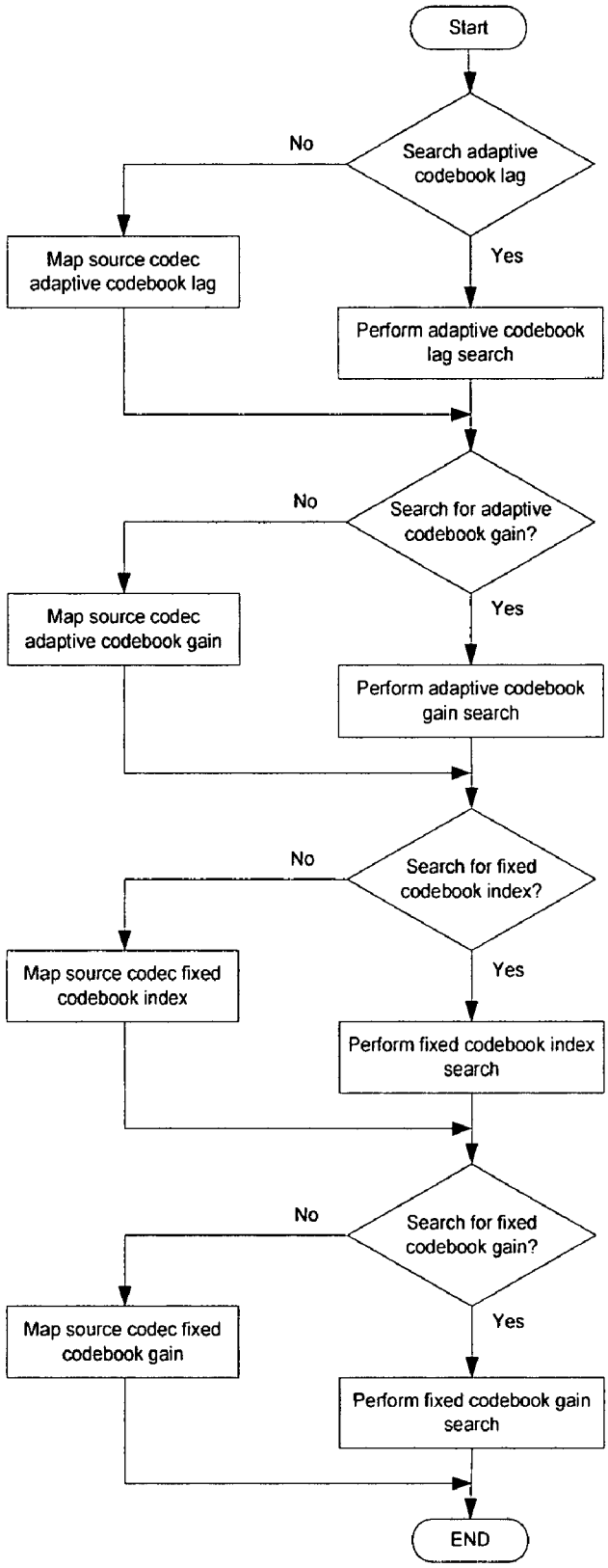
FIG. 11 is a flowchart of an excitation parameter searching method according to an embodiment of the present invention.

FIG. 11 shows a flowchart of an embodiment of the common codec (CELP) parameters searching method. For each of the common codec parameters of adaptive codebook lag, adaptive codebook gain, fixed codebook index and fixed codebook gain, a decision is made as to whether to directly map the parameter from the source codec (e.g., CELP) parameter set, or to perform a search for that parameter. The decision is controlled by the transcoding strategy selected, which is based on the source and destination codec pair.

Figure 12:
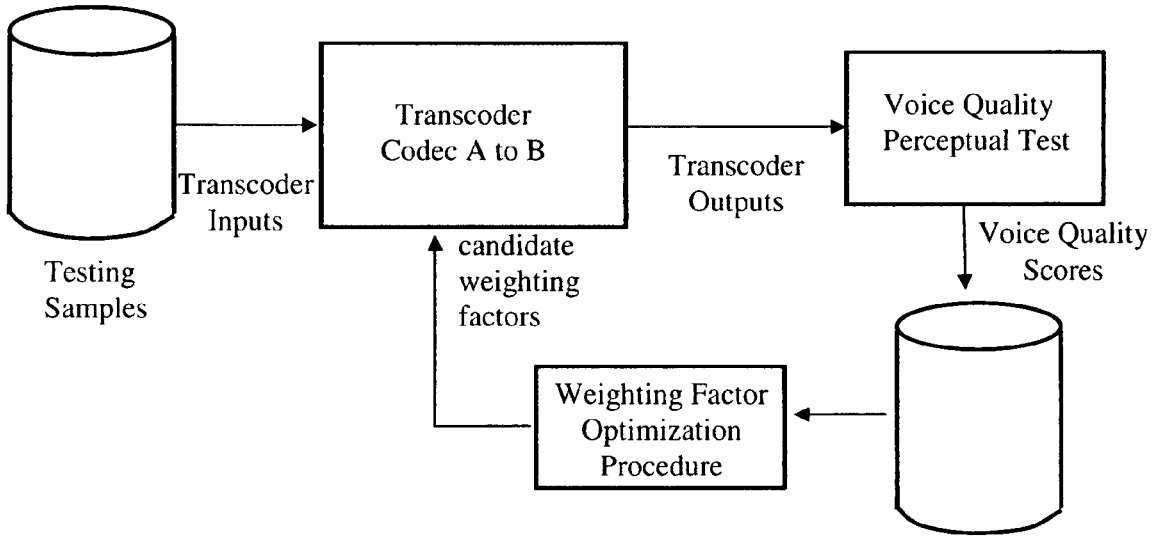
FIG. 12 is a schematic diagram of the process to obtain weighting factors for a speech perceptual weighting filter for a specific source and destination codec pair according to an embodiment of the present invention.

FIG. 12 is an illustration of the procedure used to optimize the weighting factors for the perceptual weighting filter used in searching for excitation parameters of the destination codec. The perceptual weighting filter can be expressed by the transfer function:

$$H_w(z) = \frac{A\left(\frac{z}{\gamma_1}\right)}{A\left(\frac{z}{\gamma_2}\right)},$$

where $A(z)=1+a_1z^{-1}+a_2z^{-2}+\ldots+a_Nz^{-N}$, $a_1, \ldots$ represent the linear prediction coefficients for the current speech segment, and $\gamma\mathbf{1}$. $\gamma\mathbf{2}$ are the weighting factors. The quality of the transcoded output speech can be improved by tuning or customizing the weighting factors to best suit the source and destination codec pair. This can be done using automatically using feedback methods or using empirical methods by performing the transcoding on a set of test samples using different weighting factor combinations, evaluating the output voice quality by subjective or objective methods and retaining the weighting factors that result in the highest perceived or measured output voice quality for that specific source and destination codec pair.

As an example, high quality voice transcoding is applied between GSM-AMR (all modes) and G.729. A person skilled in the relevant art will recognize that other steps, configurations and arrangements can be used without departing from the spirit and scope of the present invention.

The GSM-AMR standard utilizes a 20 ms frame, divided into four 5 ms subframes. For the highest GSM-AMR mode, LP analysis is performed twice per frame, and once per frame for all other modes. The open loop pitch estimate is obtained from the perceptually weighted speech signal. This is performed twice per frame for the 12.2 kbps mode, and once per frame for the other modes. The closed loop pitch search and fixed codeword search are both performed once per subframe, and the fixed codebook is based on an interleaved single-pulse permutation (ISPP) design.

The G.729 standard utilizes a 10 ms frame divided into two 5 ms subframes. LP analysis is performed once per frame. The open loop pitch estimate is calculated on the perceptually weighted speech signal, once per frame. Like GSM-AMR, the closed loop pitch search and fixed codeword search are both performed once per subframe, and the fixed codebook is based on an interleaved single-pulse permutation (ISPP) design.

For the G.729 to GSM-AMR transcoder, two input G.729 frames produces one GSM-AMR output frame. The LP parameters, codebook index, gains and pitch lag are unpacked and decoded from the input bitstream. Due to the differences in search procedures, codebooks, and quantization frequency of some parameters, the best transcoding strategy may differ depending on the AMR mode. In particular, the similarities associated with G.729 and AMR 7.95 kbps may lead to the configuration of a transcoding strategy that selects more parameters for direct mapping and less parameters for searching than the G.729 to AMR 4.75 kbps transcoder.

If the transcoding strategy specifies that some excitation parameters are found by searching methods, the synthesized reconstructed excitation signal is perceptually weighted to produce a target signal. The best weighting factors for the perceptual weighting filter for each mode and bit rate of the source and destination codecs of the transcoder are determined prior to transcoding. Typically, when transcoding from G.729 to AMR 12.2 kbps, a different set of weighting factors will be used than for transcoding to other AMR modes, for example, from G.729 to AMR 7.95 kbps or from G.729 to AMR 4.75 kbps.

In a transcoding scenario, the upper quality limit is the lower of the source codec quality or destination codec quality.

The high quality voice transcoding of the present invention is able to significantly reduce the quality gap between the upper quality limit and the quality obtained by the tandem coding solution.

Figure 13:
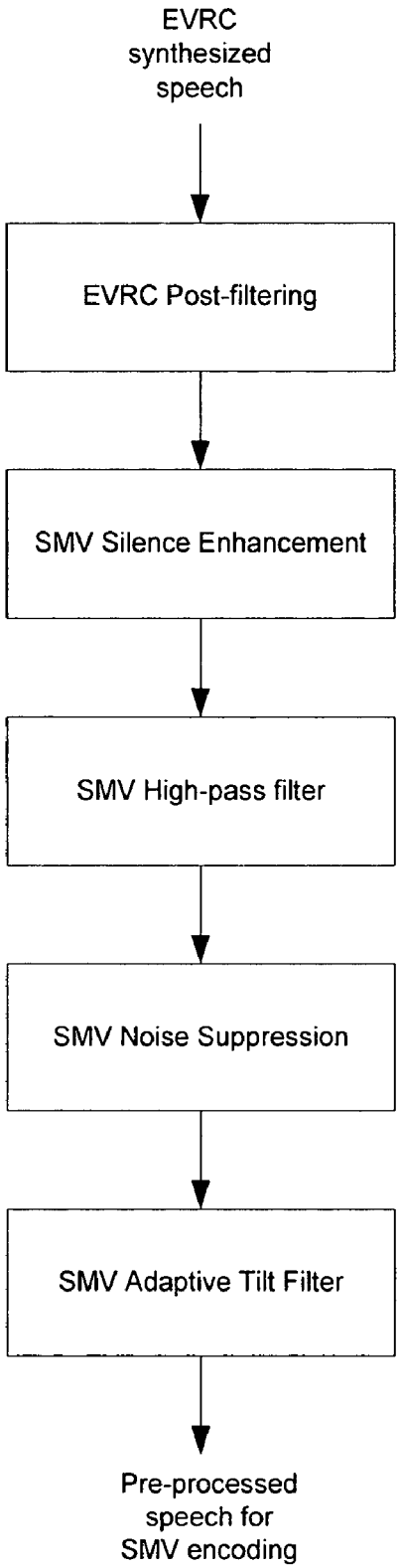
FIG. 13 is a flowchart illustrating the post-processing and pre-processing functions used in tandem transcoding from EVRC to SMV.

In an alternative embodiment, voice transcoding is applied in a transcoder whereby the source codec is the Enhanced Variable Rate Codec (EVRC) and the destination codec is the Selectable Mode Vocoder (SMV). SMV and EVRC are both common codec parameters types that employ built-in noise suppression algorithms. A flowchart of the post-processing functions of EVRC and the pre-processing functions of SMV used in the tandem transcoding solution is illustrated in FIG. 13. A transcoding solution with lower complexity and higher quality than the tandem transcoding solution can be achieved by removing one or more of the processes of EVRC postfiltering, SMV highpass filtering, SMV silence enhancement, SMV noise suppression, and SMV adaptive tilt filtering. Since EVRC already uses noise suppression, much of the background noise in the input has already been removed at the source encoder, hence a second noise suppression algorithm during transcoding causes further speech degradation with little change to the background noise level. Further complexity reductions and/or quality improvements can be realized using the optimization of perceptual weighting factors, and the mixed transcoding strategy of mapping some parameters in the CELP domain and determining some by searching.

The present invention for high voice quality transcoding is generic to all voice transcoding between CELP-based codecs and applies any voice transcoders among the existing codecs G.723.1, GSM-EFR, GSM-AMR, EVRC, G.728, G.729, SMV, QCELP, MPEG-4 CELP, AMR-WB, and all other future CELP based voice codecs that make use of voice transcoding. The foregoing common codec standards for each of which a common codec parameter space is defined are considered exemplary but not limiting.

Figure 14:
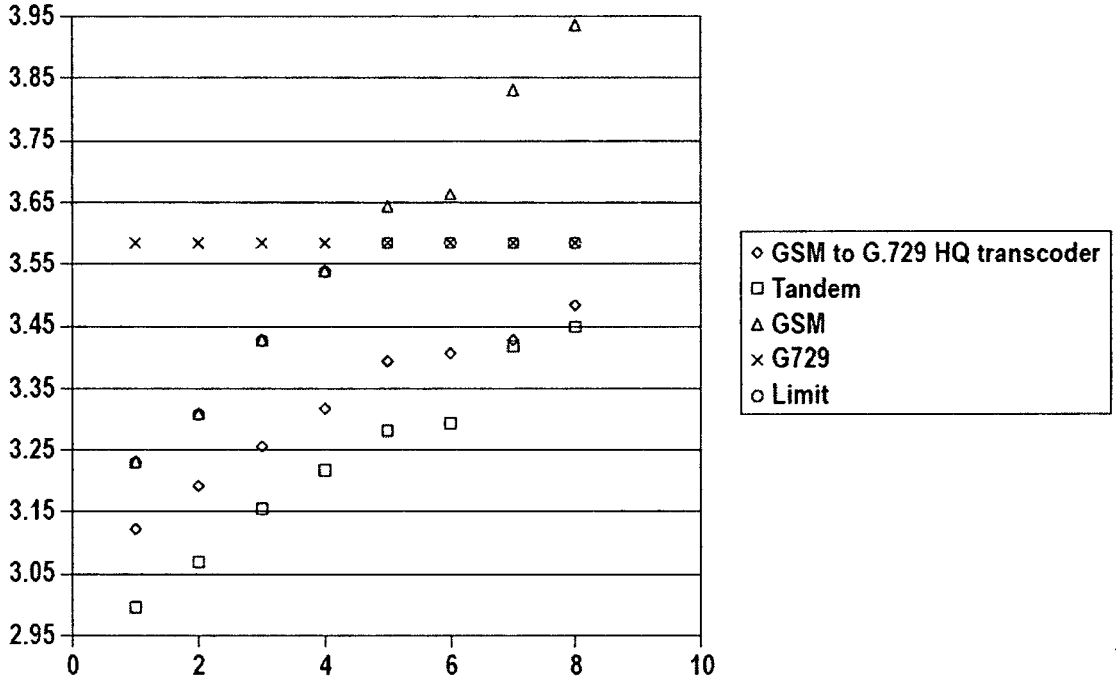
FIG. 14 illustrates the PESQ voice quality comparison between a high voice transcoder and a tandem transcoder for the GSM-AMR to the G.729 direction.

FIG. 14 shows the result of the GSM-AMR to G.729 high quality audio transcoder. The quality of source and destination codecs are also showed for the reference.

Figure 15:
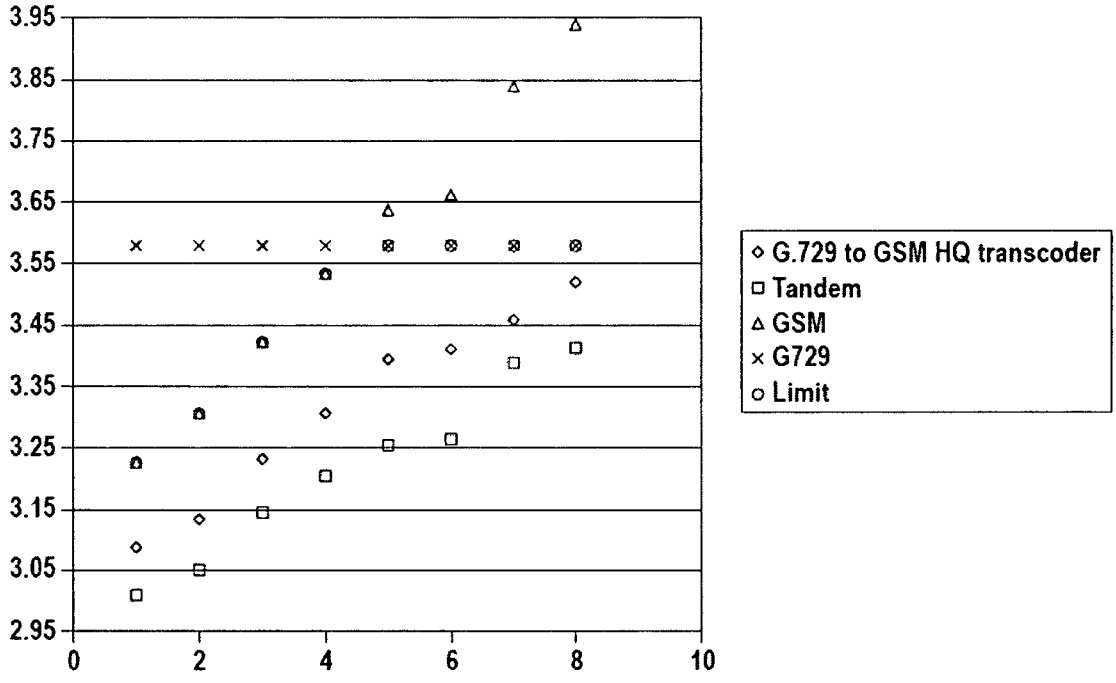
FIG. 15 illustrates the PESQ voice quality comparison between a high voice transcoder and a tandem transcoder for the G.729 to GSM-AMR direction.

FIG. 15 shows the result of the G.729 to GSM-AMR high quality audio transcoder. The quality of source and destination codecs are also showed for the reference. The quality was measured using the ITU recommendation P.862 (PESQ). On average, the high quality audio transcoder performed 0.1 better on the PESQ scale than the tandem solution. Some modes performed as high as 0.14 better than tandem. In a transcoding scenario, the limiting factor is the worst of the source or destination quality. This limiting factor is also shown in FIGS. 14 and 15. It can be seen that the high quality audio transcoder algorithm was able to get closer to this limit than the tandem solution, in some cases, making up 65% of the gap between the tandem solution and the limit.

Figure 16:
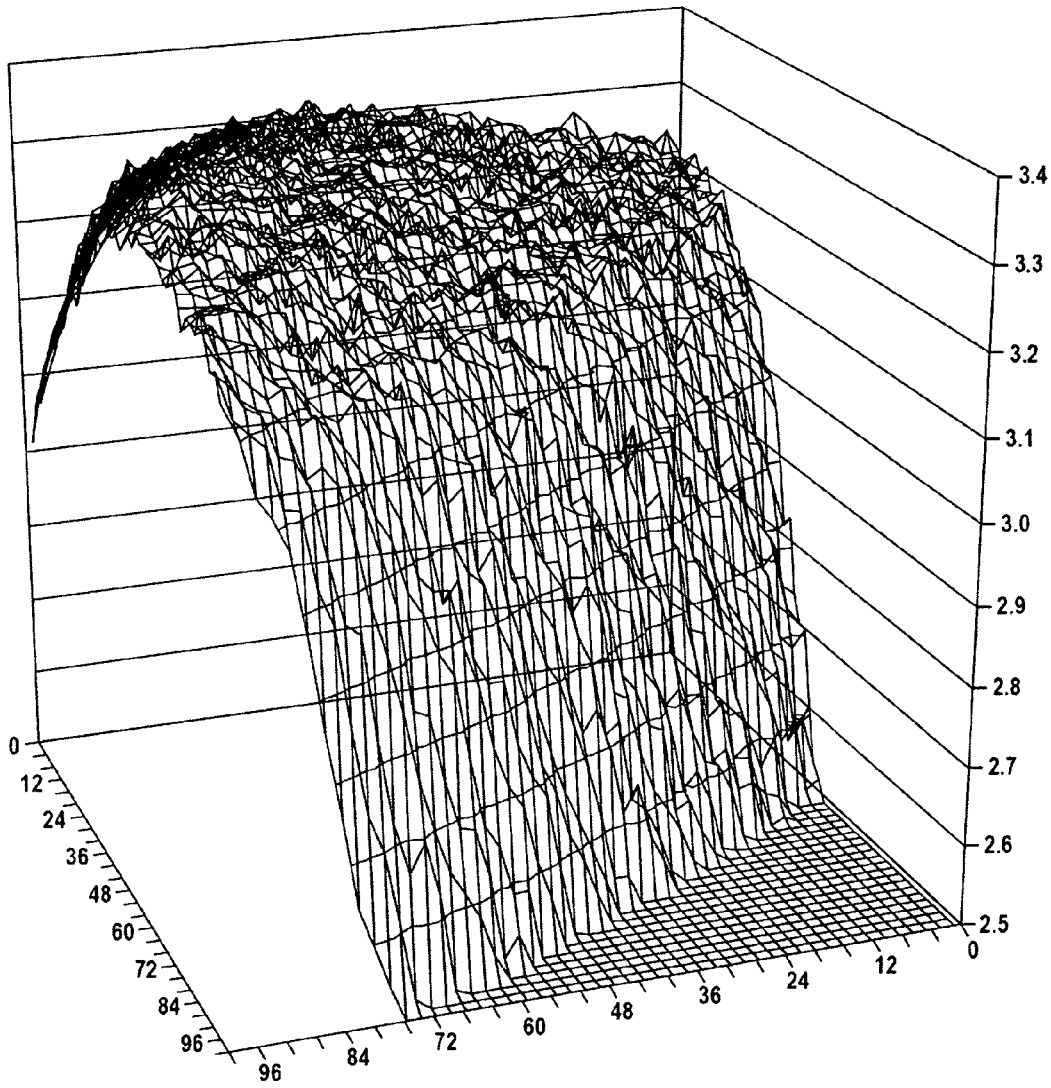
FIG. 16 illustrates voice quality with tuning of a perceptual weighting filter.

The audio quality was able to be further improved by modifying the perceptual weighting factors, $\gamma_1$ and $\gamma_2$. FIG. 16 shows the PESQ result for gamma tuning for the 12.2 mode. Table 1 shows the best gamma values for all the modes.

TABLE 1

| GSM-AMR Mode | γ1 | γ2 |
|---|---|---|
| 12.2 | 0.90 | 0.50 |
| 10.2 | 0.88 | 0.42 |
| 7.95 | 0.92 | 0.50 |
| 7.4 | 0.9 | 0.48 |
| 6.7 | 0.82 | 0.52 |
| 5.9 | 0.8 | 0.4 |

TABLE 1-continued

| GSM-AMR Mode | γ1 | γ2 |
|---|---|---|
| 5.15 | 0.9 | 0.5 |
| 4.75 | 0.9 | 0.4 |

By tuning the gamma values, it was possible to get an average improvement of 0.02, thus further improve the voice quality.

The foregoing description of specific embodiments is provided to enable a person having ordinary skill in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What is claimed is:

1. A method for producing a destination codec bitstream from a source codec bitstream in order to perform audio transcoding between a source codec and a destination codec, the method comprising:

providing a perceptual weighting filter associated with transcoding between the source codec and the destination codec;

unpacking the source codec bitstream to produce source codec parameters;

reconstructing an audio signal using the source codec parameters;

mapping one or more parameters in a parameter space to provide one or more mapped parameters;

perceptually weighting the audio signal using the perceptual weighting filter;

searching for one or more excitation parameters; and packing one or more mapped parameters and the one or more excitation parameters to the destination codec bitstream.

2. The method of claim 1 wherein one or more weighting factors associated with the perceptual weighting filter are different from one or more weighting factors prescribed in a standard for the destination codec.

3. The method of claim 1 wherein reconstructing the audio signal is free from one or more of a post filtering process, a high pass filtering process, a silence enhancement process, a noise suppression process, or a tilt filtering process.

4. The method of claim 1 wherein reconstructing the audio signal is free from two or more of a post filtering process, a high pass filtering process, a silence enhancement process, a noise suppression process, or a tilt filtering process.

5. The method of claim 1 wherein the one or more parameters comprise one or more of linear prediction coefficients, an adaptive codebook pitch lag, an adaptive codebook pitch gain, a fixed codebook index, or a fixed codebook gain.

6. The method of claim 1 wherein the perceptual weighting filter has one or more predetermined weighting factors optimized for the source codec and the destination codec.

7. The method of claim 1 wherein mapping further comprises one of:

performing linear prediction analysis to determine one or more linear prediction coefficients for further processing, or copying the source codec parameters to the mapped parameters, or converting the source codec parameters to the mapped parameters without searching using an algorithm from the destination codec.

8. The method of claim 1 wherein searching further comprises minimizing an error between a reconstructed signal and a target signal to determine one or more quantized values, wherein the one or more quantized values are selected from at least one of an adaptive codebook pitch lag, an adaptive codebook pitch gain, a fixed codebook index, or a fixed codebook gain.

9. The method of claim 1 wherein searching further comprises:

minimizing an error between a reconstructed signal and a target signal; and mapping or copying at least one of an adaptive codebook pitch lag, an adaptive codebook pitch gain, a fixed codebook index, and a fixed codebook gain.

10. The method of claim 1 wherein searching comprises performing a search method different than a standard search method prescribed in a standard for the destination codec.

11. The method of claim 1 wherein the destination codec bitstream is characterized by a quality measured using P.862, the quality being greater than another quality associated with a second destination codec bitstream produced by a process utilizing the source codec bitstream, a standard decoder for the source codec, and a standard encoder for the destination codec.

12. The method of claim 11 wherein the source codec is GSM-AMR or G.729, the destination codec is G.729 or GSM-AMR, and the quality is greater than the another quality by 0.14.

* * * * *